United States Patent [19]

Petrie

[11] 4,280,237

[45] Jul. 28, 1981

[54] FLOATING BUOY

[75] Inventor: Warren A. Petrie, New Orleans, La.

[73] Assignee: J. Ray McDermott & Co., Inc., New Orleans, La.

[21] Appl. No.: 947,356

[22] Filed: Oct. 2, 1978

[51] Int. Cl.[3] ..... B63B 21/52

[52] U.S. Cl. ..... 9/8 R

[58] Field of Search ..... 114/230, 326, 179, 181, 114/293, 219, 220; 9/8 R; 267/140

[56] References Cited

U.S. PATENT DOCUMENTS

| | | | |
|---|---|---|---|
| 197,041 | 11/1877 | Manton | 114/179 |
| 2,413,210 | 12/1946 | Blackman | 114/219 |
| 2,680,859 | 6/1954 | Hultberg | 9/8 R |
| 2,960,055 | 11/1960 | Tomer | 114/219 |
| 3,132,417 | 5/1964 | Irwin | 9/8 R |
| 3,618,150 | 11/1971 | Anselmi | 9/8.3 E |
| 3,664,653 | 5/1972 | Walker | 114/219 |
| 3,674,225 | 7/1972 | Johnson | 9/8 R |
| 3,916,467 | 11/1975 | Curd | 9/8 R |
| 3,939,510 | 2/1976 | Curd | 9/8.3 E |
| 3,950,806 | 4/1976 | Puchois | 9/8 R |
| 4,028,759 | 6/1977 | Toups | 9/8 R |

FOREIGN PATENT DOCUMENTS

| | | | |
|---|---|---|---|
| 122578 | 7/1971 | Norway | 114/220 |
| 304535 | 1/1929 | United Kingdom | 9/8 R |
| 327441 | 4/1930 | United Kingdom | 114/230 |
| 858461 | 1/1961 | United Kingdom | 9/8.3 E |
| 1020199 | 2/1966 | United Kingdom | 9/8 R |
| 1269496 | 4/1972 | United Kingdom | 9/8 R |

OTHER PUBLICATIONS

Resinex Brochure (2 pp.).

George Brook Taylor, "Inexpensive Boat Accessories," Aug. 1950, pp. 180–181; *Popular Mechanic,* vol. 94, No. 2.

*Primary Examiner*—Trygve M. Blix

*Assistant Examiner*—Jesus D. Sotelo

*Attorney, Agent, or Firm*—Arnold, White & Durkee

[57] ABSTRACT

A floating buoy for use in a marine environment includes a buoyant body for maintaining the buoy afloat, the body including a resilient outer skin, a low density filler within the outer skin, and a central core disposed between an upper end and a lower end of the body and adapted to permit the passage of a line therethrough. Upper and lower protective caps are removably attached at upper and lower ends of the body respectively, the caps each including an opening to permit the passage of the line therethrough. Affixed to the outer surface of each cap is a plurality of resilient fenders, the cap and fender structure being adapted to absorb shock loading on the buoy resulting from contact with foreign objects. The caps may be easily removed and repaired or replaced, thereby extending the useful life of the buoy.

14 Claims, 3 Drawing Figures

FLOATING BUOY

BACKGROUND OF THE INVENTION

This invention relates to equipment for use in marine operations and more particularly to the use of floating buoys in such operations.

Many different types of operations in a body of water, such as mineral exploration or salvage operations, make use of floating buoys which are utilized for various purposes, such as to indicate subsurface locations of interest or to secure lines of various types at the surface of the body of water to provide a convenient connection to undersea equipment. One particular application for such buoys, for example, involves the raising and lowering of anchors for non-powered vessels, such as barges. A discussion of this particular use for such buoys will serve to illustrate the design requirements and the problems which may be generally encountered in utilizing such floating buoys.

A barge is typically immobilized in a desired location by mooring lines leading from the vessel and connected to the shanks of one or more anchors embedded in the seabed. Such barges frequently are not equipped with their own hoisting means. Furthermore, it would be difficult to raise the anchor by raising the mooring line from the barge, since a force applied to the anchor line will tend to cause the anchor to dig in and hold even more firmly. Therefore, a second line, known as a pendant line, is commonly attached to the back portion, or "mud palm", of the anchor. When the pendant line is raised, the anchor will release without digging in. A second vessel, such as a tugboat which is equipped with a hoisting winch, is thus typically utilized to hoist each pendant line and thereby raise each barge anchor when the barge is to be relocated.

Floating buoys are frequently used to mark the surface locations above such anchors and to maintain the upper ends of the pendant lines at the surface so that a tugboat may readily locate and attach each pendant line to its hoisting equipment when the anchors are to be raised. The buoys which have been used for such an operation typically include a central core or hawse pipe through which the pendant line may freely travel. The upper end of the pendant line is terminated in an eye and the hawse pipe is provided with a stopper to prevent the eye from dropping through the hawse pipe. When the anchor is to be raised, the tugboat maneuvers sufficiently close to the location of the buoy and personnel on the boat retrieve the eye attached to the pendant line. The eye may then be connected to a hoisting winch on the tug and the pendant line reeled in, raising the attached anchor. During the hoisting operation, the pendant line slides through the hawse pipe of the buoy, and the buoy floats in the water adjacent to the side or stern of the boat, retained by the pendant line.

The necessarily close proximity between the buoy and the tugboat during such an operation can lead to problems. Such buoys are often large and somewhat massive structures, on the order of 10 feet in diameter. Particularly in rough or heavy seas, the buoy may strike the boat structure with considerable force, frequently causing damage to the boat or to the buoy or to both. In addition, the task of hooking the eye at the end of the pendant line can be very hazardous due to the erratic movements of the floating buoy which may occur relative to the tugboat, especially during rough or heavy seas.

In the past, a number of approaches have been attempted to resolve these problems. Many such buoys in the prior art were made of steel with pneumatic ballast tanks provided therein for flotation. The manufacturers of such buoys tended to make them heavier and stronger to avoid damage or destruction of the buoy in such operations, but heavier buoys tended to cause commensurately greater damage to the boat structure. Another approach which was tried involved providing spring steel bands around the buoy structure. The bands, however, were found to eventually develop jagged edges which caused further damage to a boat. Another attempted solution has involved redesigning the tug which is used to retrieve the buoy and raise the anchor. A catamaran type of tug has been developed, having twin hulls and a basket structure mounted between the hulls. The catamaran tug is maneuvered until the buoy is positioned within the tug between the hulls, and the basket is then used to catch the buoy and raise it out of the water, isolating it from wave motion. This approach helps to reduce the hazards involved in hooking the eye of the pendant line, but damage still may be caused to both the boat and the buoy structure by contact between them.

Other buoys have been developed which are manufactured from resilient materials and thus will yield upon contact and avoid damage to the boat structure. Such buoys typically have been made with a rubber or elastomeric outer skin filled with a foam material to provide flotation. These resilient buoy designs have helped to reduce or eliminate damage which otherwise was caused to the boat structure by contact with the buoy, but such buoys experience greatly reduced useful lifetimes due to the relative weakness of the resilient materials. It has been found that during such an anchor raising operation, the forces exerted on a resilient buoy by the pendant line and the inevitable contact with the boat tend to cause the resilient body of the buoy to be torn away from the central core or hawse pipe of the buoy. Such resilient buoys have been improved and strengthened by the addition of end caps which are made of a more durable material, such as steel. Such end caps, however, tend to some extent to reintroduce the problem of damage to the ship structure by contact with the buoy. Furthermore, even the stronger steel structure of the end caps may eventually be damaged in operation. Once such end caps are damaged, the resilient buoy can no longer be used.

Consequently, there has developed a need for a floating buoy whose construction will provide sufficient durability but which will not damage the structure of a ship when it is contacted by the buoy.

In addition, it would be advantageous to provide such a buoy which is repairable to thereby extend its useful life. In particular, it would be advantageous to provide such a buoy with components which are replaceable when worn or damaged.

SUMMARY OF THE INVENTION

It is a general object of this invention to provide a new and improved floating buoy.

It is a feature of this invention to provide a floating buoy whose structure is adapted to prevent damage to vessels contacting the buoy.

It is another feature of this invention to provide a floating buoy exhibiting extended durability and a prolonged useful service life.

It is an additional feature of this invention to provide a floating buoy which is repairable and reusable after suffering damage.

It is also a feature of this invention to provide a floating buoy with replaceable component parts.

The floating buoy of this invention includes a buoyant body for maintaining the buoy afloat and a protective cap removably attached to the body at a first end of the body, the cap being adapted to prevent damage to the body through contact with foreign objects.

The buoy may further include a central core disposed within the body between the first end and a second end of the body and adapted to allow the passage of a line therethrough, and a first opening disposed within the protective cap to permit the passage of the line therethrough.

In a preferred embodiment, the buoy includes a second protective cap removably attached to the body at the second end for preventing damage to the body through contact with foreign objects, the second cap including an opening to permit the passage of the line therethrough.

In a more particular embodiment, the invention includes a first bolting platform affixed to the core at the first end, and a second bolting platform affixed to the core at the second end, the bolting platform being adapted to provide for attachment of the first and second caps to the body.

In a preferred embodiment, the buoy of this invention is approximately spherical in overall shape, while the body is frustospherical in shape.

In a more particular embodiment the body includes a resilient outer skin, which may be made of a filament reinforced elastomer, and a low density filler within the outer skin, which may comprise a singular closed cell foam.

In the preferred embodiment, the invention includes a plurality of resilient fenders attached to the outer surface of each protective cap, the fenders being adapted to absorb shocks resulting from contact between the buoy and foreign objects.

Also in the preferred embodiment, the walls of the openings in the protective caps define curvilinear shapes having a minimum radius of curvature such that potential damage to the line resulting from bending around the openings is minimized.

Examples of the more important features of this invention have thus been broadly outlined in order that the detailed description thereof that follows may be better understood, and so that the contributions which this invention provides to the art may be better appreciated. There are, of course, additional features of the invention which will be described herein and which will be included within the subject matter of the claims appended hereto.

BRIEF DESCRIPTION OF THE DRAWINGS

Additional objects, features, and advantages of the present invention will become apparent by reference to the following detailed description of the preferred embodiments thereof in connection with the accompanying drawings, wherein like reference numerals refer to like elements throughout all the figures. In the drawings.

DESCRIPTION OF THE PREFERRED EMBODIMENTS

Figure 1:
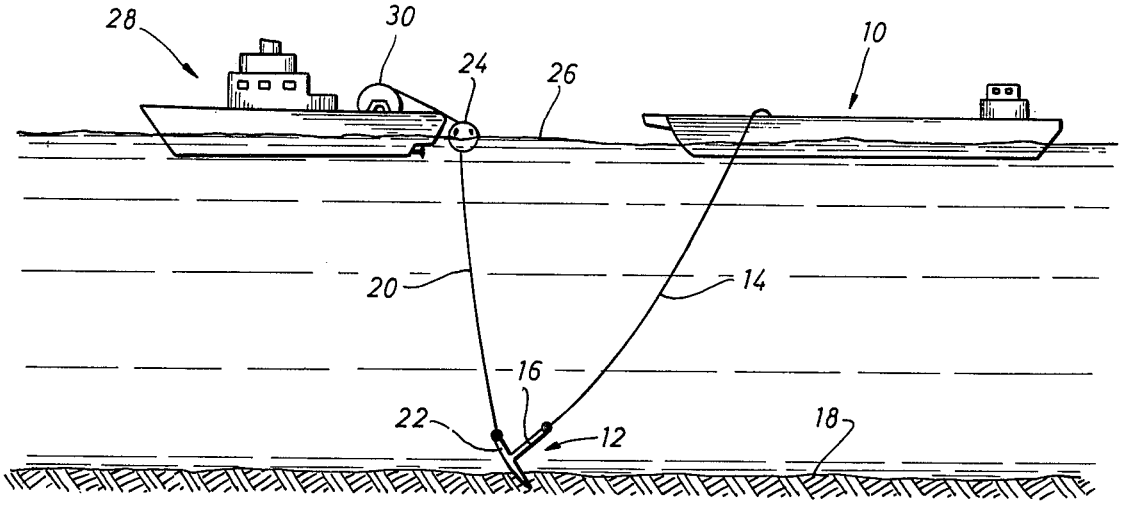
FIG. 1 is a pictorial view which illustrates the deployment of a preferred embodiment of the invention as it would be utilized in one possible operating environment.

Now referring to the drawings, and first to FIG. 1, the preferred embodiment of a buoy constructed in accordance with this invention is illustrated in a typical operating environment. A barge 10 is positioned in a desired location by one or more anchors, such as anchor 12, which are connected to the barge 10 through one or more mooring lines, such as mooring line 14, which is affixed to the shank 16 of the anchor 12. Although frequently multiple anchors and mooring lines are utilized, the function and handling of each anchor is similar, so that the description herein need only refer to one such anchor and mooring line. Furthermore, although the preferred embodiment of this invention is particularly adapted for use as an anchor buoy, those skilled in the art will appreciate that the features and advantages of the invention may be utilized in and adapted to many other applications for floating buoys.

Where it is necessary to relocate the barge 10 from time to time, it is advantageous to provide a second line for dislodging the anchor 12, since the anchor will exhibit considerable resistance to the direct hoisting of mooring line 14, as the anchor is designed to dig more deeply into the seabed 18 in response to a force exerted on the mooring line. Thus, it is a common practice to provide a pendant line 20, which is affixed to the back portion or mud palm 22 of the anchor 12. When the pendant line 20 is hoisted, the anchor 12 may be dislodged form the seabed and raised with comparatively little resistance. After all such anchors have been raised, the barge 10 may then be moved to the desired new location and the anchors may be lowered and reset.

In order to facilitate locating and raising the anchor 12, the pendant line 20 is run through a buoy 24, which is constructed according to the present invention and which will float on the surface 26 of the water, thereby providing a visual indication marking the location of the anchor 12 and maintaining the upper end of the pendant line 20 at the surface of the water so that the line may be retrieved and raised when necessary.

When it is desired to raise the anchor 12, a properly equipped boat, such as the tugboat 28, is maneuvered close to the buoy. Personnel on the boat 28 then manually hook an eye which is affixed to the end of the pendant line 20, which in turn is positioned at the upper end of the buoy 24 by a stopper (not shown) which prevents the eye from passing through the buoy 24. After the pendant line 20 has thus been retrieved, it is fastened to a winch 30 on the boat 28. The winch is then activated to reel in the pendant line 20 and thereby raise the anchor 12 from the seabed 18.

Although a conventional type of tugboat 28 is illustrated in FIG. 1, it will be appreciated by those skilled in the art that a catamaran tugboat, which is specially adapted to retrieve anchor buoys, may be used in this operation as well. A catamaran tugboat is constructed with twin hulls, between which is mounted a basket adapted to receive a floating anchor buoy. The tugboat is maneuvered until the buoy is positioned within the basket, then the basket is raised to remove the buoy from the water and thereby immobilize it, facilitating the retrieval of the eye at the upper end of the pendant line.

Referring again to FIG. 1, as the anchor is raised, the pendant line 20 slides through a central opening, known as the hawse pipe, within the buoy 24. Consequently, during the winching operation, the buoy 24 is restrained by the line 20 and held near to or adjacent the stern or sides of the boat 28. In this position, the wave motion of the water surface frequently causes the buoy 24 and the tug boat 28 to come into contact. If the anchor weighing operation is taking place during adverse conditions, such as when there are heavy or rough seas present, the contact between the boat and buoy can occur with considerable destructive force. This contact has frequently resulted in damage to boats and to buoys in the past, often requiring expensive and time consuming shipyard repairs for the boats and shortening the useful life of such buoys because of the damage done. The buoy of this invention is designed to ameliorate these disadvantages caused by the buoys which have been used in the prior art.

Figure 2:
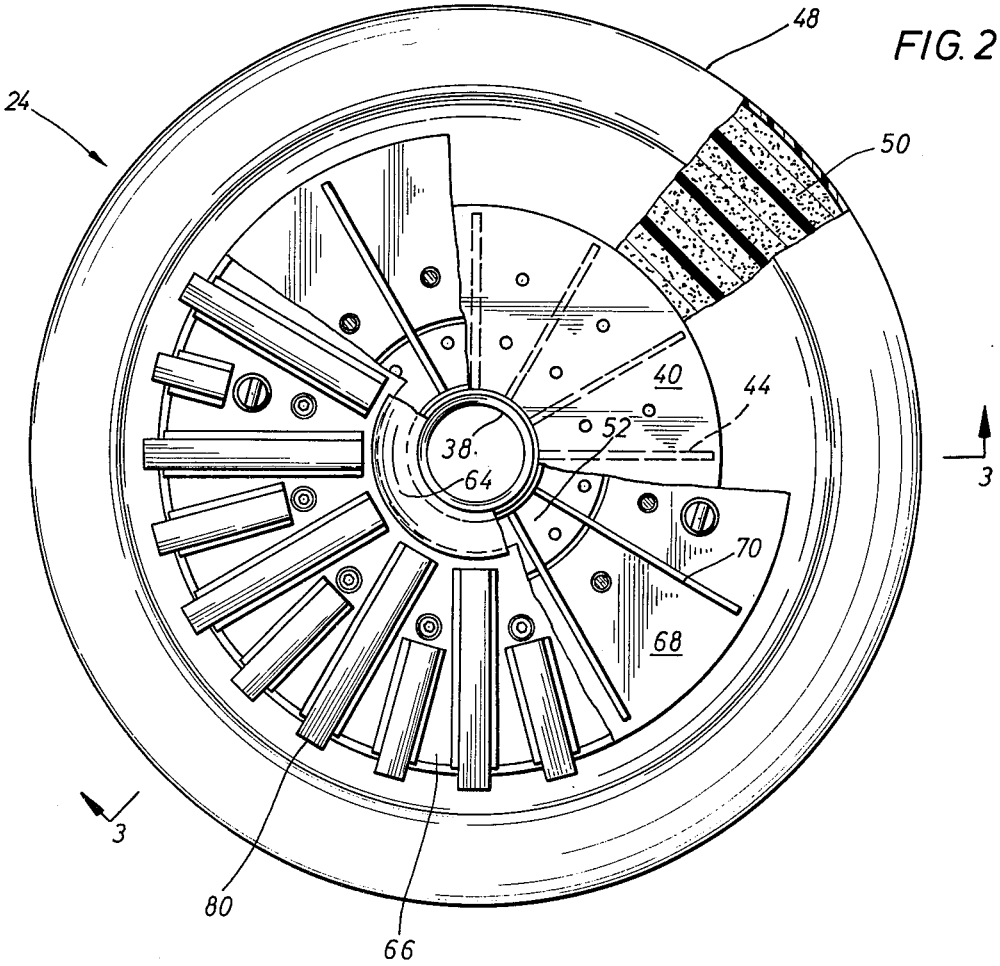
FIG. 2 is a plan view in partial cross-section showing the buoy illustrated in FIG. 1.
Figure 3:
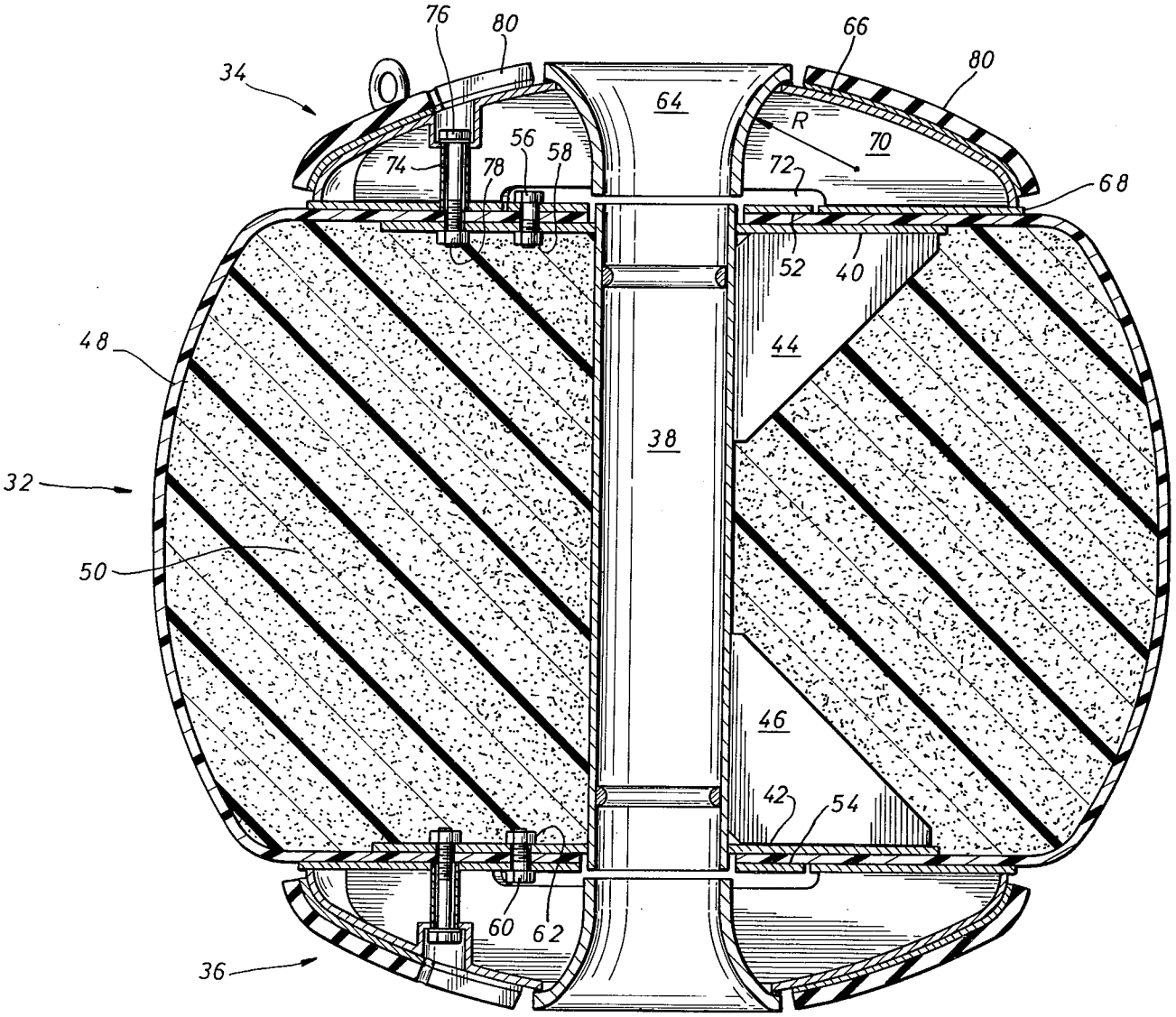
FIG. 3 is a side elevation in cross section illustrating the buoy shown in FIG. 1, taken along the lines 3—3 of FIG. 2.

Now referring to FIGS. 2 and 3, a detailed illustration of the buoy 24 of FIG. 1 is shown. FIG. 2 is a plan view of the buoy, while FIG. 3 is a cross sectional view from a side elevation, along the line 3—3 of FIG. 2. The buoy 24 includes a buoyant body 32 and upper and lower protective caps 34 and 36, respectively, which are attached to the body 32 at its upper and lower ends and protect the body against damage through contact with foreign objects, while also reducing the potential for damage to such other objects.

Positioned within the body 32 is a hollow central core or hawse pipe 38. The core 38 is provided within the body so that a line, such as the pendant line 20 illustrated in FIG. 1, may freely slide through the buoy 24. The core 38 is required because of the use of the preferred embodiment illustrated herein as an anchor buoy. As will be appreciated by those skilled in the art, however, such a core is not an essential feature of this invention, and other embodiments may be envisioned without this element of the design. The core 38 is formed out of a cylindrical section of a rigid material, such as steel. Welded to the central core at its upper and lower ends are upper and lower annular bolting platforms 40 and 42, respectively. Additional structural rigidity for the core 38 is provided by a plurality of upper triangular reinforcements 44 and lower triangular reinforcements 46, which are welded between the central core 38 and the upper and lower bolting platforms 40 and 42, respectively. This support structure assembly establishes a rigid mounting structure to which the buoyant body 32 and the upper and lower protective caps 34 and 36 may be attached.

The buoyant body 32 is constructed of a resilient outer skin 48, which is filled with a low density filler 50 to provide buoyancy for the buoy. In the preferred embodiment illustrated, the outer skin 48 is manufactured of a $\frac{5}{8}$ inch thick filament reinforced urethane elastomer, which is colored traffic yellow for high visibility. The low density filler utilized in the preferred embodiment is a singular closed cell foam, which is made up of a combination of semi-rigid polyethylene foam, having a density of 8 to 9 pounds per cubic foot, and a flexible polyethylene foam, having a density of 2 pounds per cubic foot. Other low density filler materials, as will be appreciated by those skilled in art, might also be used to advantage in this invention to provide buoyancy.

Although the embodiment of the invention illustrated includes a buoyant body 32 which is formed with a resilient or flexible outer structure, those skilled in the art will appreciate that the features and advantages of the invention might also be attained with other types of buoy structures, such as rigid bodied buoys.

The structural shape and integrity of the buoyant body 32 is maintained by clamping the resilient outer skin 48 to the upper and lower bolting platforms 40 and 42, respectively. In assembling the body 32, the outer skin 48 is positioned over the upper and lower bolting platforms 40 and 42, upper and lower bolting rings 52 and 54 are placed over the outer skin 48 at the upper and lower ends thereof, respectively, and the outer skin 48 is then tightly clamped at its upper and lower ends between the bolting platforms and the bolting rings by means of upper bolts 56, which engage upper nuts 58, and lower bolts 60, which engage lower nuts 62.

One outstanding feature of this invention resides in the design of the upper and lower protective caps denoted 34 and 36, respectively, in the drawings. Since the design of these caps is identical, the detailed discussion of the structure of the caps which follows herein will refer to the upper protective cap 34 only, it being understood that the description applies equally well to the structure of the lower protective cap 36, since the buoy 24 which is illustrated is essentially symmetrical in design. Although both an upper and a lower protective cap are provided in the preferred embodiment illustrated and discussed herein, it should be understood that the advantages of this invention may also be obtained in some instances by the use of a buoy equipped with only one protective cap, such as where the contact between the buoy and other objects is expected to occur only at one end of the buoy, for example.

Now referring to the structure of the upper cap 34, as illustrated in FIGS. 2 and 3, within the center of the upper cap 34 is provided a bell mouth 64. The bell mouth 64 includes a radiused opening for the protection of any line passing therethrough, as will be discussed further herein. Welded to the bell mouth 64 is an outer cap portion 66, while an annular cap portion 68 is welded at its outer circumference to the lower edge of the outer cap portion 66. Welded between the bell mouth 64, the outer cap portion 66, and the inner cap portion 68 are a plurality of cap reinforcements 70, which each include a radiused opening 72 so that the reinforcements 70 will clear the bolting ring 52 and the bolts 56 when the upper cap 34 is attached to the body 32.

According to another outstanding feature of this invention, the upper protective cap 34 is removably attached to the body 32, so that the upper cap may be easily removed and repaired or replaced when required. In order to permit removal of the cap, bolting wells 74 are provided within the upper cap 34, and bolts 76 fit into the wells 74 and engage nuts 78, which are welded to the underside of the upper bolting ring 40, to connect the upper cap to the body 32. When the upper cap 34 is thus attached to the body 32, the tightening of bolts 76 on nuts 78 provides an additional means for securing the resilient outer skin 48 to the upper bolting ring 40.

Another outstanding feature of this invention resides in the fenders 80, which are attached to the exterior of the outer cap portion 66 of the upper cap 34. When the buoy is in service in a body of water, the protective caps 34 and 36 will cover the surface area of the buoy which most frequently comes into contact with a ship or other foreign object. The fenders 80 provide a resilient shock absorbing surface on the protective caps so that such contact with a ship will not damage the ship. In the preferred embodiment illustrated, the fenders 80 are made up of Morse fenders, of the flat type, part number E44950. These fenders consist of an elastomeric portion which is bonded to a steel base. In the preferred embodiment, the steel bases of the fenders 80 are welded to the outer cap portion 66 of the upper protective cap 34.

Over a period of time when the buoy is in use, the fenders 80 may become damaged or worn by contact with boats or other foreign objects. When this damage reaches the point that replacement or repair is desirable, the protective cap 34 may be readily removed from the body 32 by removing bolts 76 from nuts 78. The upper cap 34 may then be repaired and rebolted to the body 32, or, if necessary, a replacement upper cap 34 may be attached to the body 32.

As mentioned above, the bell mouth 64 includes a radiused opening, having a radius R as shown in FIG. 3, which is designed to minimize damage to a line passing through the central core 38 and the opening 64, such as the line 20 shown in FIG. 1. Any such line will have associated therewith a minimum bending radius, which varies depending upon the type, structure, and size of the line, beyond which the line may not be bent without causing structural damage to the line. Thus, the radius R for the bell mouth 64 is selected to be no less than that necessary to avoid damage to the particular size and type of line which is contemplated to be used in conjunction with the buoy 24. The line 20, as illustrated in FIG. 1, may then freely slide within the buoy 24 and may flex around the radiused bell mouth 64 as the line passes out of the buoy without suffering damage.

As illustrated in the drawings, the overall shape of the buoy 24 is approximately spherical, with the body 32 exhibiting a frustospherical shape having truncated ends which allow for the attachment of protective caps 34 and 36. This overall spherical shape is especially advantageous where such a buoy is to be retrieved by a catamaran type of tugboat, as previously discussed herein.

Although typical embodiments of the present invention have been illustrated and discussed herein, further modifications and alternative embodiments of the apparatus and method of this invention will be apparent to those skilled in the art in view of this description. Accordingly, this description is to be construed as illustrative only and is provided for the purpose of teaching those skilled in the art the manner and technique of constructing the apparatus of this invention. It is to be understood that the forms of the invention shown and described herein are considered the presently preferred embodiments, although various changes might be made in the configurations, sizes, and arrangements of the parts, as will be recognized by those skilled in the art, without departing from the scope of the invention. Equivalent elements, for example, might be substituted for those illustrated and described herein, parts or connections might be reversed or otherwise interchanged, and certain features of the invention might be utilized independently of the use of other features, all as will be apparent to one skilled in the art after receiving the benefit attained through reading the foregoing description of the invention.

What is claimed is:

1. A floating buoy for use in a marine environment, the buoy comprising:

a buoyant body for maintaining the buoy afloat with a first end of the body directed upwardly to constitute its upper end during use;

a first securing platform on the upper end of the body; and a first protective cap removably secured to the first securing platform to extend over the upper end of the body for providing a protective surface over that end to protect the body from contact with a marine vessel during use;

the first protective cap being generally dome shaped to provide a convex protective surface for minimizing impact damage to a marine vessel during impact between the protective cap and such a marine vessel when the buoy is in use, and the first protective cap further extending beyond the periphery of the first securing platform to cover the platform and prevent contact between the platform and a marine vessel during use.

2. A buoy according to claim 1, having a second securing platform on a second opposed end of the body to constitute its lower end, and having a rigid core member rigidly fixed to and extending between the two securing platforms with the securing platforms extending transversely to the length of the core member.

3. A buoy according to claim 2, in which the body comprises a resilient, outer skin and a low density filler within the outer skin, the filler extending from one securing platform to the other around the core member, and the outer skin being located in position by having opposed edges secured to the respective securing platforms.

4. A buoy according to claim 3, including a pair of securing rings which are secured to the respective securing platforms to clamp the edges of the outer skin between them and the respective securing platforms and thereby secure the outer skin in position.

5. A buoy according to claim 4, including a second protective cap corresponding to the first protective cap, the second protective cap being removably secured to the second securing platform, and each protective cap having an internal annular wall to cooperate with a securing platform during securing of the protective cap to the securing platform to further clamp edge zones of the outer skin in position on the securing platform between it and the internal annular wall.

6. A buoy according to claim 5, in which each internal annular wall has an opening to accommodate one securing ring.

7. A buoy according to claim 3, including a plurality of reinforcement panels which extend radially from the core member, each panel having one edge fixed to the core member and having another edge fixed to a securing platform to reinforce the securing platform and provide surfaces engaged by the filler to locate the filler in position in the body.

8. A buoy according to claim 5, in which the core member has a tubular bore for admitting a line, and in which each securing platform and each protective cap has a corresponding bore for admitting such a line.

9. A buoy according to claim 8, in which the bore of each protective cap is defined by a bell mouth member located therein.

10. A buoy according to claim 1, in which the protective cap has resilient fender means mounted on its outer surface for reducing shock resulting from contact between the protective cap and a marine vessel.

11. A buoy according to claim 10, in which the fender means comprises a plurality of resilient fender strips which are arranged at circumferentially spaced intervals to extend radially from the outer periphery of the cap towards its apex.

12. A floating buoy for use in a marine environment, the buoy comprising:

a buoyant body for maintaining the buoy afloat, the body comprising an elongated core member having first and second securing platforms mounted at its opposed ends to extend transversely to the axis of the core member, a low density filler material around the core member and extending from the one securing platform to the other securing platform, and a resilient outer skin surrounding the filler material and being located in position by having opposed edges thereof clamped onto the outer surfaces of the securing platforms by means of securing rings secured to the securing platforms to clamp the edges between the respective securing rings and the securing platforms; and first and second protective caps removably secured to the first and second securing platforms respectively to extend over the securing platforms for providing protective surfaces over the opposed ends of the buoy to protect the body from contact with marine vessels during use, the protective caps being shaped to minimize impact damage to marine vessels during impact between a protective cap and a marine vessel during use.

13. A floating buoy for use in a marine environment, the buoy comprising:

a buoyant body for maintaining the buoy afloat;

a first securing platform on a first end of the body; and a first protective cap removably secured to the first securing platform to extend over the first end of the body for providing a protective surface over that end to protect the body from contact with a marine vessel during use;

the first protective cap being shaped to provide a convex protective surface for minimizing impact damage to a marine vessel during impact between the protective cap and such a marine vessel when the buoy is in use, the protective cap having resilient fender means mounted on its outer surface for reducing shock resulting from contact between the protective cap and a marine vessel.

14. A buoy according to claim 13, in which the fender means comprises a plurality of resilient fender strips which are arranged in circumferentially spaced intervals to extend radially from the outer periphery of the cap towards its apex.

* * * * *